US005485168A

United States Patent [19]

Parekh

[11] Patent Number: 5,485,168

[45] Date of Patent: Jan. 16, 1996

[54] MULTIBAND SATELLITE COMMUNICATION ANTENNA SYSTEM WITH RETRACTABLE SUBREFLECTOR

[75] Inventor: Sharad V. Parekh, Dallas, Tex.

[73] Assignee: Electrospace Systems, Inc., Richardson, Tex.

[21] Appl. No.: 360,338

[22] Filed: Dec. 21, 1994

[51] Int. Cl.[6] ..... H01Q 3/20

[52] U.S. Cl. ..... 343/761; 343/781 P; 343/839

[58] Field of Search ..... 343/761, 781 R, 343/781 CA, 781 P, 779, 839, 840; H01Q 3/12, 3/20

[56] References Cited

U.S. PATENT DOCUMENTS

| | | | |
|---|---|---|---|
| 3,534,375 | 10/1970 | Stelzried et al. | 343/839 |
| 3,623,109 | 11/1971 | Neumann | 343/722 |
| 4,305,075 | 12/1981 | Salvat et al. | 343/761 |
| 4,464,666 | 8/1984 | Watanabe et al. | 343/731 |
| 4,525,719 | 6/1985 | Sato et al. | 343/761 |
| 4,562,441 | 12/1985 | Beretta et al. | 343/781 |
| 4,603,334 | 7/1986 | Mizuguchi et al. | 343/779 |
| 4,618,866 | 10/1986 | Makino et al. | 343/779 |
| 4,755,826 | 7/1988 | Rao | 343/781 |
| 4,783,664 | 11/1988 | Karikomi et al. | 343/781 |
| 4,811,029 | 3/1989 | Nomoto et al. | 343/779 |
| 4,823,143 | 4/1989 | Bockrath | 343/781 |
| 4,847,574 | 7/1989 | Gauthier et al. | 33/21 |
| 4,914,443 | 4/1990 | Gans et al. | 342/361 |
| 4,956,864 | 9/1990 | Brockman | 380/34 |
| 5,075,692 | 12/1991 | Huruno et al. | 343/781 |
| 5,136,294 | 8/1992 | Iwata | 343/781 |
| 5,198,827 | 3/1993 | Seaton | 343/779 |
| 5,321,413 | 6/1994 | Lenormand | 343/755 |

*Primary Examiner*—Donald T. Hajec
*Assistant Examiner*—Tan Ho
*Attorney, Agent, or Firm*—Richards, Medlock & Andrews

[57] ABSTRACT

A multiband satellite communication antenna system includes a primary reflector and one or more movable subreflectors. A system with one subreflector operates at a first band when the subreflector is in a deployed position and reflects energy between a first feed and the primary antenna. When the subreflector is at a second, stowed, position, the primary reflector operates directly into a second feed. A communication antenna system with two subreflectors can operate at three bands under the conditions of having either both subreflectors stowed; the first subreflector deployed and the second subreflector stowed; or both subreflectors deployed.

7 Claims, 5 Drawing Sheets

MULTIBAND SATELLITE COMMUNICATION ANTENNA SYSTEM WITH RETRACTABLE SUBREFLECTOR

TECHNICAL FIELD OF THE INVENTION

The present invention pertains in general to satellite communications and in particular to communication antenna systems for multiband use.

BACKGROUND OF THE INVENTION

Satellite communications are expanding to cover substantially different frequency bands including C, Ku, X and EHF. There are now both military and commercial satellites operating on these different frequency bands. It has become important in the military environment, and may become important in the commercial environment, for a single operator to communicate through satellites at substantially different frequency bands. This becomes a particular problem because it is often necessary to change feeds for operation at different bands. This is generally time-consuming and difficult, and in some circumstances, such as aboard ship, it is also dangerous. Thus, there has developed a need for satellite communication antenna systems which can operate at multiple bands without the need for manually interchanging feeds.

One approach to this problem is the use of a dichroic surface which separates the two bands that must be used. A dichroic surface is electromagnetically transparent to one band but opaque to the other band. The use of a dichroic reflector has the advantage that both bands can be operated simultaneously, but this is gained only at the expense of additional insertion loss in each band due to the non-ideal nature of the dichroic surface. Further, it is very difficult to design a dichroic surface with low-loss characteristics and the necessary high efficiency needed for satellite use.

A further approach is to utilize multiple feeds that are mechanically moved into position as needed. However, this requires the use of either flexible transmission lines or complex mechanical joints, both of which are expensive and difficult to use.

Therefore, there exists a need for a satellite antenna configuration which can operate at multiple bands with high efficiency, rapid transition from one band to the other and relative mechanical simplicity.

SUMMARY OF THE INVENTION

A selected embodiment of the present invention comprises a multiband satellite communications antenna system. This system includes a primary reflector and a movable subreflector. The subreflector has a deployed position in which the subreflector reflects energy between the primary reflector and a first feed. The subreflector further has a stowed position in which a second feed is positioned at a focused location of the primary reflector. A mechanical drive is connected to the subreflector to selectively position it in either the deployed position or the stowed position.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION

Figure 1:
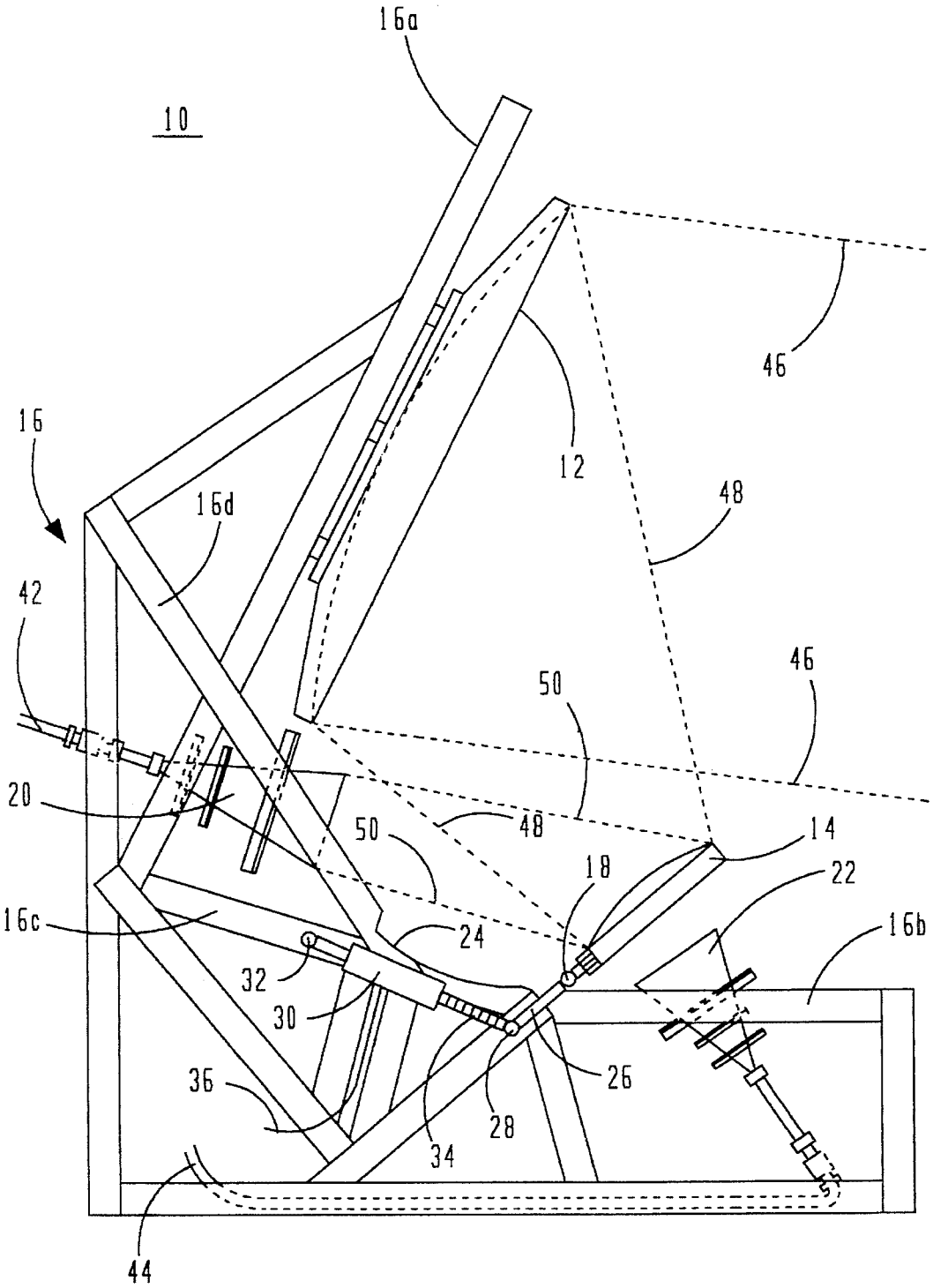
FIG. 1 is an elevation view of a multiband satellite communication antenna system in accordance with the present invention wherein a subreflector is located in a deployed position to reflect energy from a primary reflector to a first feed while blocking energy from the primary reflector to a second feed.
Figure 2:
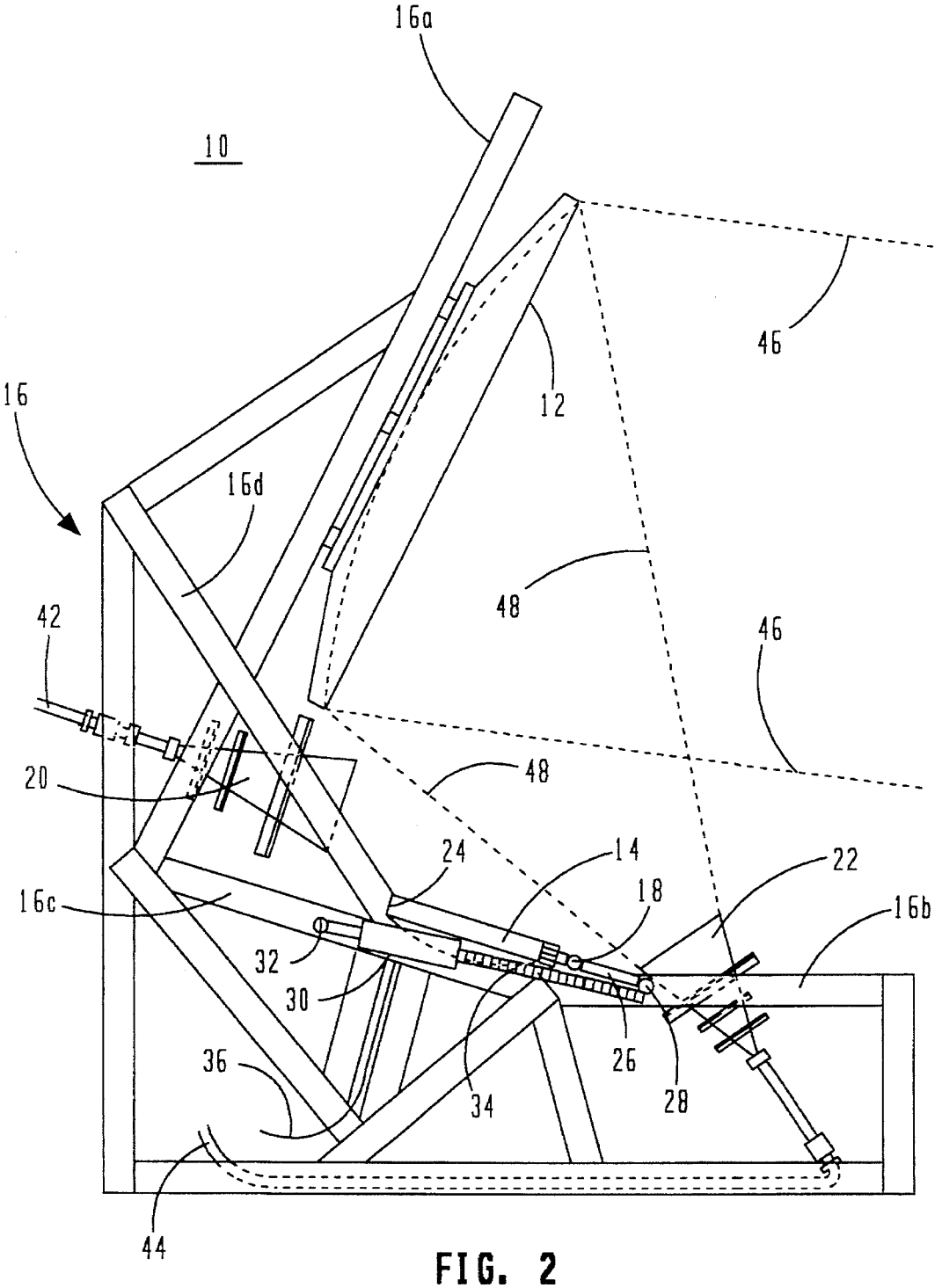
FIG. 2 is a further illustration of the embodiment shown in FIG. 1 in which the subreflector is located in a stowed position so that energy from the primary reflector is focused directly to the second feed.

Referring to FIGS. 1 and 2, a first embodiment of the present invention comprises a multiband satellite communication antenna system 10 which includes a primary reflector 12 and a subreflector 14. The primary reflector 12 and subreflector 14 are mounted on a multicomponent frame 16. The primary reflector is mounted on a beam 16*a* and the subreflector 14 is mounted by means of a pivot 18 to a beam 16*b*.

The primary reflectors and subreflectors of the present invention are conventional antenna reflectors.

The communication antenna system 10 further includes a feed 20 which is mounted below the primary reflector 12. A second feed 22 is mounted at the lower, left position of the frame 16.

In a configuration of the antenna system 10 for operation at C and Ku band, the feed 20 is for the Ku-band operation and feed 22 is for C-band operation. The subreflector 14 should be used with the shortest wavelength band.

In FIG. 1, the subreflector 14 is showed in a deployed position. In FIG. 2, the subreflector 14 is located in a recess 24 in a beam 16*d* and when the reflector 14 is in this recess, it is in a stowed position.

The subreflector 14 is mounted on a pivot 18 and is further connected to an arm 26 which has a pivoting joint 28 at the end thereof. An electrical stepper motor 30 is mounted by means a pivoting connection 32 to a beam 16*c* of the frame 16. The motor 30 drives a threaded shaft 34 which is connected to the pivoting joint 28. When the shaft 34 is in the retracted position, the subreflector 14 is in the deployed position as shown in FIG. 1. When the electric motor 30 drives the shaft 34 to an extended position, this causes the subreflector 14 to rotate about the pivot 18 until it is positioned in the recess 24, which is the stowed position for the subreflector 14. The motor 30, which is a mechanical drive, is operated through an electrical cable 36.

The feed 20 is connected to a feed line 42 and the feed 22 is connected to a feed line 44.

As shown in FIG. 1 by lines 46, which represent a radiation beam direction, RF energy is collected (or transmitted) by the primary reflector 12 and reflected as shown by lines 48 to the subreflector 14. Lines 50 illustrate the reflection of energy between the subreflector 14 and the feed 20. When the subreflector 14 is in the deployed position as shown in FIG. 1, it blocks the transfer of energy between the primary reflector 12 and the feed 22. However, this blockage is not necessary for the operation of the antenna system 10.

The feed 20 is positioned at focal point of the subreflector 14.

Referring to FIG. 2, the beam of energy illustrated by lines 46 is reflected as shown by lines 48 to the feed 22. The subreflector 14 is in the stowed position, as shown in FIG. 2, and therefore does not block the transfer of energy between the primary reflector 12 and the feed 22. The feed 22 is positioned at a focal point of the primary reflector 12.

The primary reflector 12 preferably has a parabolic shape and the subreflector 14 has either an ellipsoidal or a hyperbolic shape. The communication system 10 is an offset-fed reflector type as shown in U.S. Pat. No. 4,783,664, which is hereby incorporated by reference.

Figure 3:
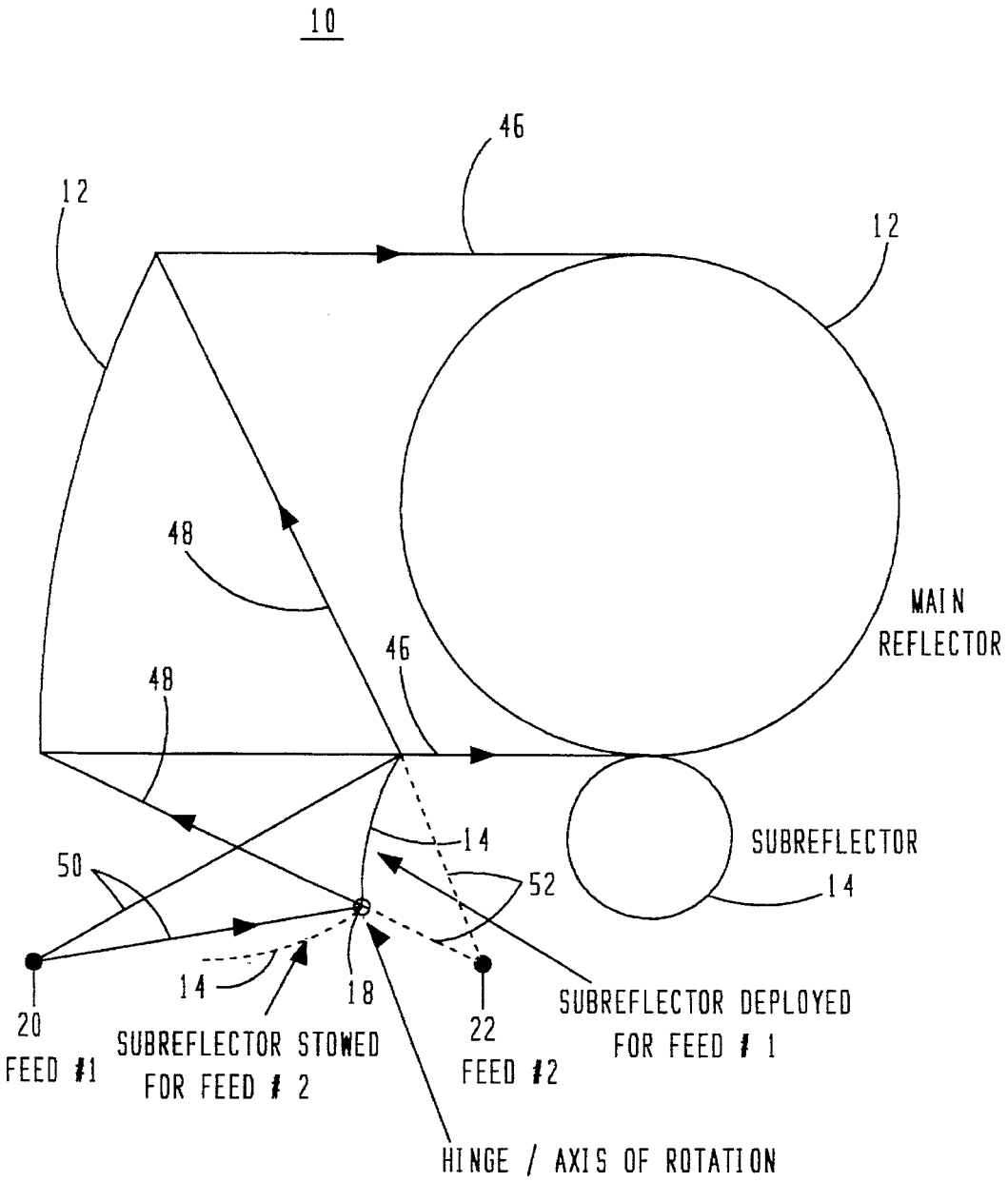
FIG. 3 is a schematic, elevation view of the embodiment shown in FIG. 1 illustrating beam reflections with the subreflector shown in both the deployed and stowed positions.

Referring now to FIG. 3, the communication system antenna 10 as shown in FIGS. 1 and 2 is illustrated in a schematic view to illustrate the beam handling. Lines 46 illustrate the beam of transmitted or received energy relative to the primary reflector 12 and a distant target. Lines 48 illustrate the beam direction for the reflected energy between the primary reflector 12 and the feed 22, also shown as Feed #2. Lines 48 and 50 illustrate the beam shape between the primary reflector 12 via the subreflector 14 to the feed 20 (also shown as Feed #1).

The subreflector 14 is shown in the deployed position as a solid line and as a dotted line in a stowed position.

Figure 4:
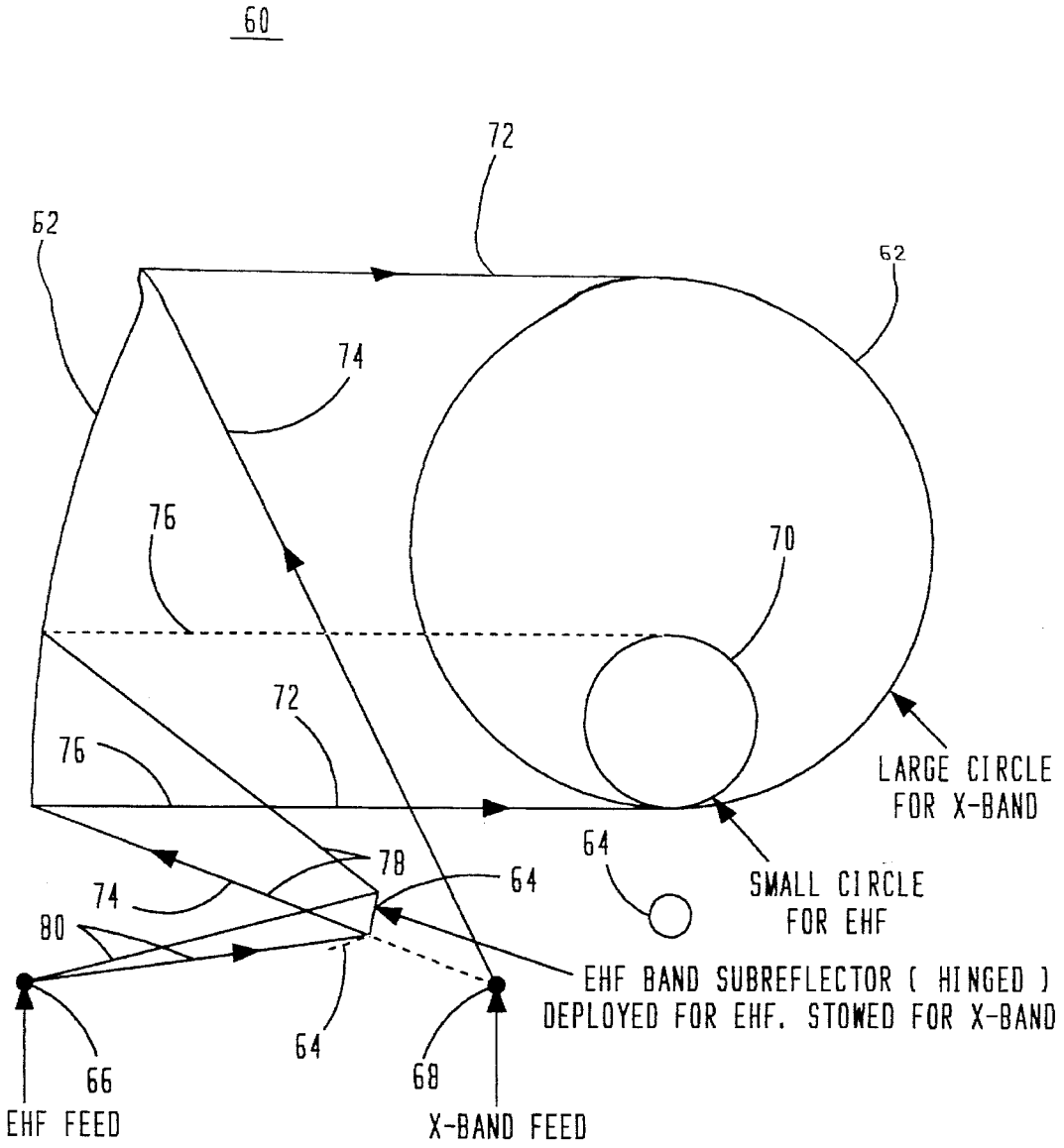
FIG. 4 is a schematic illustration of a further embodiment of the present invention wherein a subreflector reflects energy from only a portion of the primary reflector to a selected feed.

A second embodiment of the present invention is illustrated as a communication antenna system 60 shown in FIG. 4. This system is designed for use at EHF and X-band. The system 60 includes a primary reflector 62 and a subreflector 64, as well as feeds 66 and 68. The primary reflector 62 has a defined small circle area 70 which is part of its overall reflecting surface. The area 70 is preferably for operation at the EHF band while the overall primary reflector 62 is for operation at X-band. The circle area 70 is preferably a higher precision surface than the remainder of the surface of primary reflector 62

Further referring to FIG. 4, at X-band, lines 72 represent the transfer of energy to or from the primary reflector 62 with respect to a distant target. Lines 74 represent the energy beam between the primary reflector 62 and X-band feed 68.

The subreflector 64 has a deployed position, which is shown as the solid line and a stowed position which is shown as a dotted line. When in the deployed position, subreflector 64 focuses the energy reflected from the circled area 70 to the EHF-band feed 66. The subreflector 64 can be equipped with a mechanical drive just as that shown for subreflector 14 in FIG. 1.

Lines 76 represent the transfer of energy to the primary reflector 62 with respect to a distant target for EHF band. The beam defined by line 76 is further defined in a reflection beam outlined by lines 78. Note that one of the lines 78 overlaps one of the lines 74. Finally, lines 80 represent a radiation beam between the subreflector 64 and the EHF feed 66.

Referring to FIG. 4, in operation, the communication antenna system 60 operates at X-band when the subreflector 64 is stowed. This uses the X-band feed 68. When an operation is desired at the EHF-band, the subreflector 64 is rotated into its deployed position. This serves to reflect energy from the included circle area 70 to the EHF-band 66.

Figure 5:
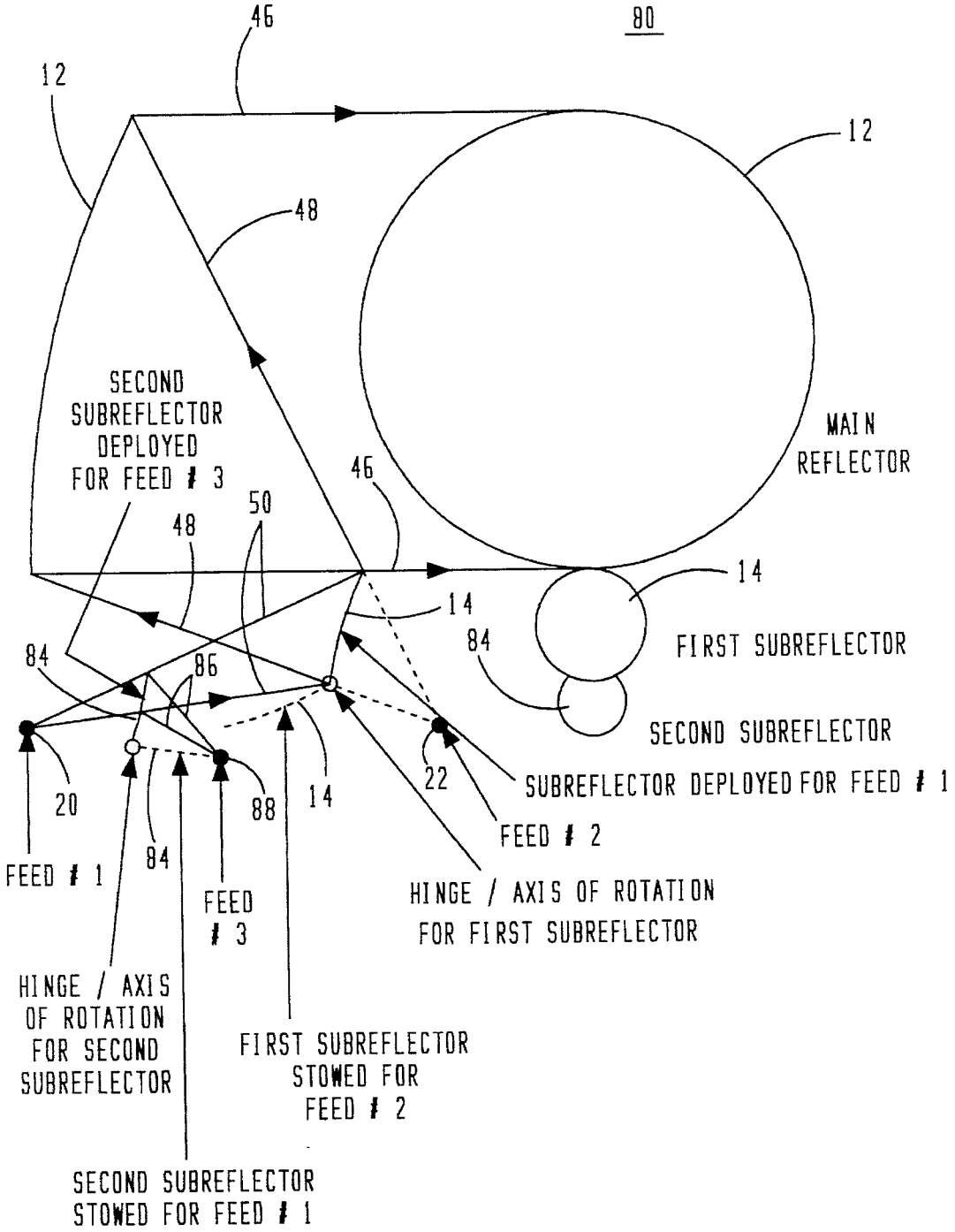
FIG. 5 is a still further embodiment of the present invention for communicating on three different bands wherein the system includes two subreflectors, each of which has a deployed and a stowed position.

A further embodiment of the present invention is illustrated as communication antenna system 80 in FIG. 5. This is essentially the same as the antenna system 10 shown in FIG. 1 but with the addition of a second subreflector 84 and a third feed 88. The subreflector 84 is shown as a solid line in the deployed position and as a dotted in the stowed position. Similar reference numerals are used for common elements in FIGS. 1 and 5.

The communication antenna system 80 operates at three satellite communication bands. When the subreflector 14 is in the stowed position, the antenna system 80 operates with feed 22, which is also identified as Feed #2.

When the subreflector 14 is in the deployed position and the subreflector 84 is in the stowed position, the communication antenna system 80 operates with feed 20, also shown as Feed #1. Thus far, this is the same as described in reference to FIGS. 1 and 2. However, when subreflector 14 and subreflector 84 are both in deployed positions, the communication antenna system 80 operates with the feed 88, shown as Feed #3. In this case, the radiant energy received by the primary reflector 12 is directed first to the subreflector 14 which in turn the directs the energy to the subreflector 84 which further directs the energy to the feed 88. Thus, by selectively positioning two subreflectors, the antenna system 80 can be operated at three bands.

A particular advantage of the present invention is that the feeds can be precisely aligned and then fixed in place. The feeds are not moved when there is a change from one band to another.

Although several embodiments of the invention have been illustrated in the accompanying drawings and described in the foregoing Detailed Description, it will be understood that the invention is not limited to the embodiments disclosed, but is capable of numerous rearrangements, modifications and substitutions without departing from the scope of the invention.

What I claim is:

1. A multiband satellite communication antenna system, comprising:

a primary reflector, a movable subreflector, a first feed, a second feed positioned at a focus location of said primary reflector, a mechanical drive connected to said movable subreflector, and said subreflector having a deployed position in which said subreflector reflects energy between said primary reflector and said first feed and said subreflector having a stowed position in which energy is reflected between said primary reflector and said second feed.

2. A multiband satellite communication antenna system as recited in claim 1 wherein said subreflector includes a pivot and said subreflector is in a first angular position about said pivot in said deployed position and in a second angular position about said pivot when said subreflector is in said stowed position.

3. A multiband satellite communication antenna system, comprising:

a primary reflector having an included reflection region in the surface thereof, a movable subreflector, a first feed, a second feed positioned at a focus location of said primary reflector, a mechanical driver connected to said movable subreflector, and said subreflector having a deployed position in which said subreflector reflects energy between said included reflection region of said primary reflector and said first feed and said subreflector having a stowed position in which energy is reflected between said primary reflector and said second feed.

4. A multiband satellite communication antenna system as recited in claim 3 wherein said subreflector includes a pivot and said subreflector is in a first angular position about said pivot in said deployed position and in a second angular position about said pivot when said subreflector is in said stowed position.

5. A multiband satellite communication antenna system, comprising:

a primary reflector, a first movable subreflector, a second movable subreflector, a first feed, a second feed positioned at a focus location of said primary reflector, a third feed, a mechanical drive for said first movable subreflector and for said second movable subreflector, and said communication antenna system having three configurations for operation at three respective frequency bands, said configurations comprising:

(1) said first subreflector located in a stowed position wherein energy is communicated between said primary reflector and said second feed for operation at a first of said frequency bands, (2) said first subreflector positioned in a deployed position and said second subreflector positioned in a stowed positioned wherein said first subreflector reflects energy between said primary reflector and said first feed for operation at a second of said frequency bands, and (3) said first and second subreflectors both in deployed positions wherein said first subreflector reflects energy between said primary reflector and said second subreflector and said second subreflector reflects energy between said first subreflector and said third feed for operation at a third of said frequency bands.

6. A multiband satellite communication antenna system as recited in claim 5 wherein said first subreflector includes a pivot and said first subreflector is in a first angular position about said pivot in said deployed position and in a second angular position about said pivot when said first subreflector is in said stowed position.

7. A multiband satellite communication antenna system as recited in claim 5 wherein said second subreflector includes a pivot and said second subreflector is in a first angular position about said pivot in said deployed position and in a second angular position about said pivot when said second subreflector is in said stowed position.

* * * * *